United States Patent [19]

Halverson

[11] 4,049,126

[45] Sept. 20, 1977

[54] WEIGHT EQUALIZED FOLDABLE BAT RACK

[75] Inventor: Lance K. Halverson, Seattle, Wash.

[73] Assignee: Rolf Sporting Goods, Inc., Seattle, Wash.

[21] Appl. No.: 670,637

[22] Filed: Mar. 26, 1976

Related U.S. Application Data

[63] Continuation-in-part of Ser. No. 589,016, June 23, 1975, abandoned.

[51] Int. Cl.[2] ..... A47F 5/08

[52] U.S. Cl. ..... 211/104; 211/60 R; 224/45 J; 248/303

[58] Field of Search ..... 211/104, 178, 60 R, 211/87, 13, 60 T, 195, 86; 248/DIG. 3, 302, 303, 249; 16/DIG. 13, 171, 172; 224/46 R, 45 J, 48 B

[56] References Cited

U.S. PATENT DOCUMENTS

| | | | |
|---|---|---|---|
| 2,429,447 | 10/1947 | Apfelbaum | 16/171 |
| 2,468,891 | 5/1949 | Neiser | 211/104 |
| 2,797,840 | 7/1957 | Gibbs | 16/171 |
| 3,491,893 | 1/1970 | Morris | 211/60 |
| 3,698,563 | 10/1972 | Gordon et al. | 211/13 |
| 3,871,526 | 3/1975 | Marsack | 211/178 |

*Primary Examiner*—Albert J. Makay
*Assistant Examiner*—Kenneth Noland
*Attorney, Agent, or Firm*—Graybeal, Barnard & Uhlir

[57] ABSTRACT

A portable bat rack having a first configuration attachable to a fence for the storage of baseball bats and a more compact second configuration of smaller dimensions for transporting the bat rack. The bat rack is front suspended adjacent each end minimizing tilting by partially equalizing the moments caused by the weight of the bats. A shelf-like first support bar is provided with individual forward opening recesses spaced laterally to independently receive each bat in a substantially vertical position. A bat receiving second support bar is provided and is detachably connected to the first support bar thereby allowing end-to-end coplanar abutting of the adjacent support bars in first configuration. A pair of hangers are pivotally attached to the first support bar near each end for attaching the bat rack to an open weave fence. A third hanger is pivotally attached to the outward end of the second support bar. Each hanger is rotatable against its respective support bar in the second configuration thereof. The hinge is separable allowing the first support bar to be used independently without the second support bar in the event a lesser amount of bat stowage is required.

14 Claims, 7 Drawing Figures

WEIGHT EQUALIZED FOLDABLE BAT RACK

REFERENCE TO OTHER APPLICATIONS

This is a continuation-in-part application of my pending U.S. patent application Ser. No. 589,016 filed June 23, 1975, now abandoned, entitled A FOLDING BAT RACK.

BACKGROUND OF THE INVENTION

1. Field of the Invention

This invention relates to a portable bat rack attachable to an open weave fence such as a chain link fence or the like and, more particularly, to a bat rack having a first configuration for storing a plurality of bats and a second more compact configuration for transporting the bat rack.

2. Description of the Prior Art

Baseball has been played for many years in this country. There are hundreds of teams comprising players organized into groups by age. Each team must have an assortment of equipment including bats, batting helmets, balls, and gloves which must be carried to each game. A team may have as many as five or six bats and a few individual players may provide their own bats. The manager or, particularly with teams composed of younger aged players, the coach often has the sole responsibility of transporting all of the team equipment from ball park to ball park. Accordingly, a highly portable, compact bat rack is a significant advantage in reducing the bulk which must both be stored and transported between games and practices.

During a game, it is advantageous for the bats to be suitably stored since, if thrown on the ground, the bats present a significant safety hazard. However, it is necessary that the bats be positioned for ready accessibility to a batter so that he might quickly grab and remove a bat from the rack but yet the rack must not allow the bats to inadvertently slide from the rack. The bat rack should be relatively small in external dimensions so that it will present a minimal obstruction along the batter's path of travel between the dugout and home plate. In addition, it should be easily and quickly attachable and detachable from a chain link fence.

U.S. Pat. No. 3,698,583 granted Oct. 17, 1972 to George E. Gordon et al. illustrates a typical bat rack which is attachable to a chain link fence for storing baseball bats in a vertical position. The bat racks utilize a single horizontally positioned support member which individually receives a plurality of bats in laterally spaced openings. This rack must be transported to each ball park in this single uncollapsible configuration with its external dimensions essentially unchanged.

In addition to the above cited patent disclosure, the referenced parent patent application and the prior art cited therein should be consulted in putting the instant invention in proper perspective.

SUMMARY OF THE INVENTION

The present invention relates to a portable bat rack having a first configuration for the storage of bats in a vertical position and a second, more compact, configuration for transporting and storing of the bat rack.

According to an aspect of the invention, a portable bat rack is provided with a front suspended bat receiving first support bar which is supported along each end so that the moment caused by the weight of the bats is partially equalized.

According to another aspect of the invention, a portable bat rack is provided with first and second self-like support bars which include front and rear edges and spaced ends. The second support bar extends the amount of available bat stowage. Individual forward opening recesses are laterally positioned on each support bar and open through the front wall to independently receive a bat in a substantial vertical position. A first and second hanger is pivotally connected near each end of the first support bar. A third hanger is pivotally attached to the outward end of the second support bar. Each hanger includes a forward opening hook which is engageable with a conventional open weave fence, such as a chain-link fence or the like, for horizontally positioning the support bars. A hinge is disposed between the first and second support bars allowing abutting of the adjacent ends in the first configuration and one-directional folding to the second configuration.

According to still another aspect of the invention, a portable bat rack is provided with a plurality of hangers pivotally attached near each end of a support bar. In a first configuration thereof, the hangers suspend the support bar in a horizontal position for vertical storage of bats. A detachable second support bar is also provided and is attached near one end of the first support bar by a hinge. The adjacent ends of the respective support bars abut; however, by one-directional folding to the second configuration thereof, the overall length of the bat rack is reduced to approximately one-half of the extended length.

According to yet another aspect of the invention, a portable bat rack is provided with a pair of support bars for receiving a plurality of bats in a vertical position. The support bars are interconnected by a separable hinge so that one of the support bars can be used alone when a fewer number of bats are stowed.

According to another object of the invention, a portable bat rack is provided with a pair of support bars for receiving a plurality of bats in a substantially vertical position. Hanger members suspend the support bars in a horizontal attitude against a fence. The forward opening hook portion of each hanger is positionable forward of the rear edge of each support bar both to stabilize the moment of the bats and to cause a front to rear cant of the suspended bat rack to compensate for a loose or sagging chain-link fence.

According to still another aspect of the invention, a portable bat rack is provided with a plurality of hangers for suspending support bars on an open weave fence in a first configuration. The hangers are pivotally attached near each end of the support bars and can be rotated to contiguous parallelism with the upper surface of each support bar forming a compact configuration for transporting the bat rack.

In view of the foregoing, it is an object of the invention to provide a bat rack having a first configuration for the storage of baseball bats and a second, more compact configuration when not in use.

It is another object of the invention to provide a portable bat rack which can be quickly and easily secured to a conventional chain-link fence in a few seconds time.

It is still another object of the invention to provide a highly portable bat rack which is convenient to transport but yet is strong and durable in use over an extended length of time.

It is yet another object of the invention to provide a small lightweight bat rack which can be easily carried by young baseball players.

It is yet another object of the invention to provide a portable bat rack which is attachable to a loose or sagging chain-link fence yet maintains a plurality of bats on a shelf-like support member for convenient removal and replacement of bats during a game.

Other and additional advantages and objects will be apparent from the following written description taken in conjunction with the accompanying drawing.

DETAILED DESCRIPTION OF THE INVENTION

Figure 1:
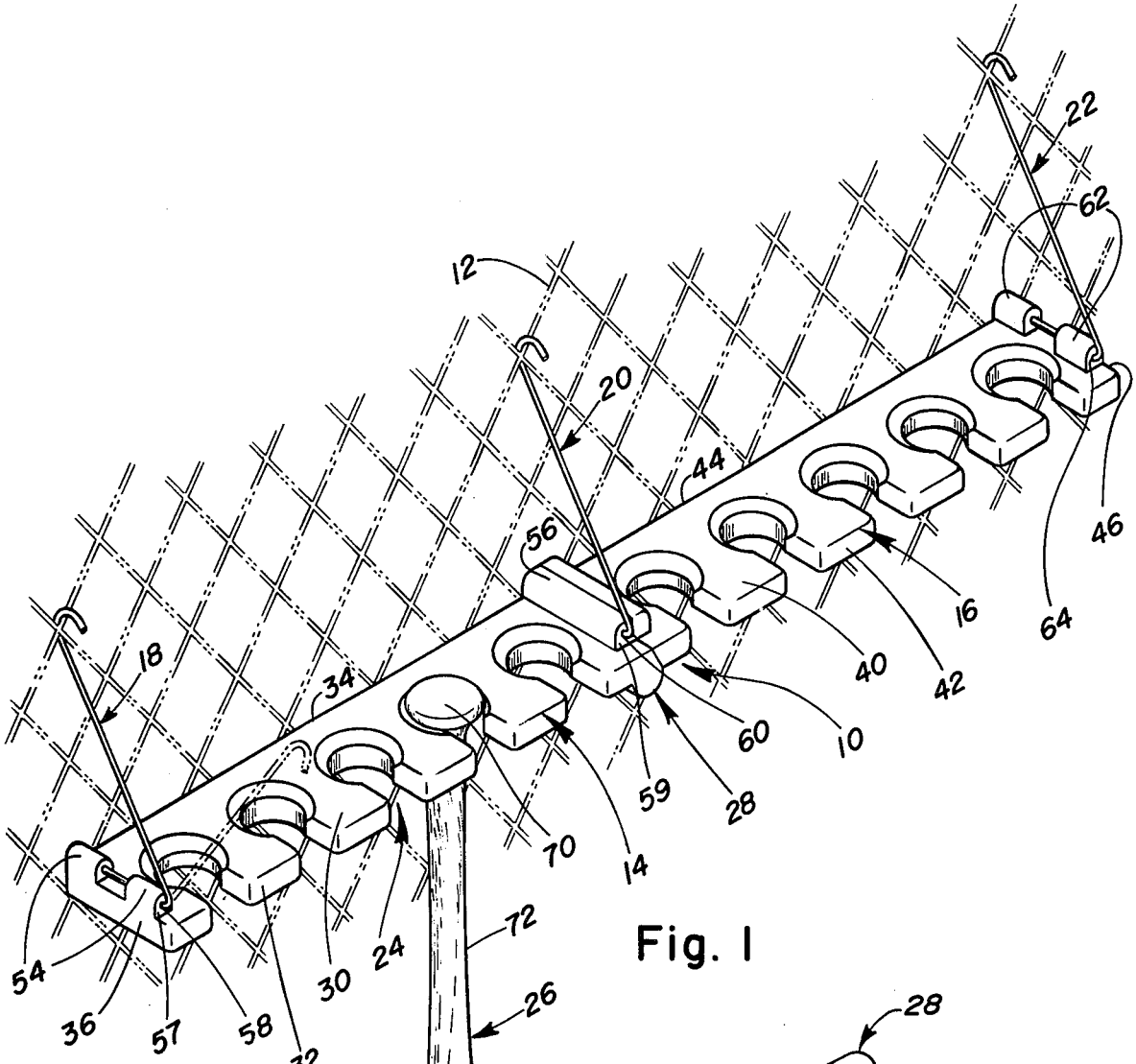
FIG. 1 is a perspective view showing a portable bat rack in the first configuration suspended from an open weave fence. One hanger is shown in broken line in the second configuration in which the bat rack is transported.
Figure 2:
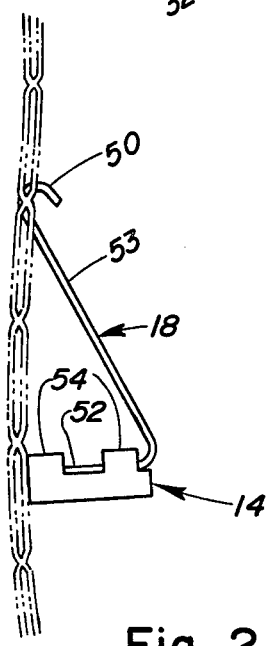
FIG. 2 is an end elevational view of the bat rack in the first configuration, also depicted as suspended from an open weave fence.

Referring initially to FIG. 1 and FIG. 2, a portable bat rack 10 according to the instant invention is shown in the first configuration suspended from a conventional open weave fence 12 such as a chain-link fence or the like. Portable bat rack 10 basically comprises a first support bar 14 and a similarly shaped second support bar 16 which extend the length of bat rack 10. A first and second hanger 18 and 20 are pivotally attached to first support bar 14 near each end. A third hanger 22 is pivotally attached near the outward end of the second support bar 16. A plurality of individual forward opening recesses 24 are laterally positioned along each support bar 14 and 16 to independently receive bat 26 (FIG. 1) for storage in a vertical position. A hinge 28 is moldingly secured between adjacent ends of the respective support bars thereby allowing both coplanar alignment of the respective support bars in the first configuration and one-directional folding to a second configuration.

In preferred form, first support bar 14 is a planar elongated member having a front edge 32 and a rear edge 34 and a top surface 30. An outward end 36 is formed adjacent the end mounting first hanger 18. At the opposite end, abutting end 38 (FIG. 5) is formed adjacent second hanger 20. In a similar manner, second support bar 16 is a planar elongated member having a front edge 42 and rear edge 44 and a top surface 40. An outward end (not shown) is formed adjacent third hanger 22. At the opposite end of second support bar 16, a vertically elongated end 48 (FIG. 4) is formed for abutting the adjacent end of first support bar 14. First support bar 14 and second support bar 16 are suspended in a substantially horizontal orientation with respective rear edges 34 and 44 in contact with open weave fence 12. Inward end 36 of first support bar 14 abuts inward end 48 of second support bar 16 so that the members form a continuous elongated surface for receiving bats.

Figure 3:
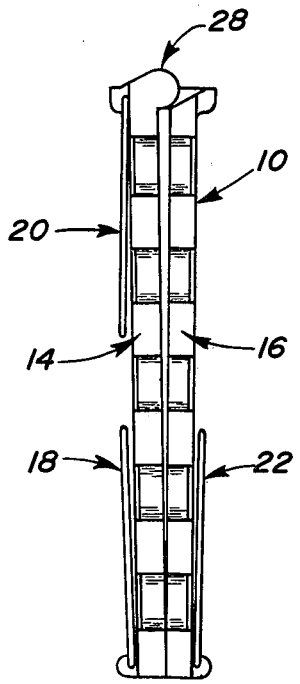
FIG. 3 is a front elevational view of the bat rack in the second more compact configuration.

Referring now to FIG. 3, portable bat rack 10 is depicted in its second, more compact, configuration for transporting or storage when not being utilized to store baseball bats. In this arrangement first support bar 14 and second support bar 16 have been rotated from their end-to-end abutting relationship of the first configuration to substantially contiguous parallelism by rotation about the transverse axis of hinge 28. The first, second and third hangers 18, 20 and 22, respectively, have been rotated from their upright positions perpendicular to upper surfaces 30 and 40 of the support bars to a position substantially parallel with each upper surface. In this second configuration the external dimensions of the bat rack are relatively small and it can be easily carried in an equipment bag or even the hip pocket of a player. In addition, as is seen in broken line (FIG. 1), the hangers do not protrude beyond the front or rear edge of either support bar thereby preventing catching or snagging with an equipment bag or pocket.

Referring again to FIG. 2 in conjunction with FIG. 1, it has been previously described that support bars 14 and 16 in the first configuration receive a plurality of bats for vertical storage. Forward opening recesses 26 engage the individual bats so that they will not become inadvertently dislodged from the bat rack. Preferably, each hanger member is somewhat S-shaped having a forward opening 50 at the upper end and a pin journal 52 (FIG. 7) at the opposite end. A canted intermediate portion 53 is formed between pin journal 52 and hook 50. First hanger 18, second hanger 20 and third hanger 22 are essentially identically shaped and are formed so that they can be folded adjacent the upper surfaces of the platforms. Mounts 54 and 56 are provided for hanger 18 and 20, respectively, and are moldingly secured near opposite ends of first support bar 14. Each mount protrudes above the upper surface 30 of platform 14 and extends to rear edge 34. The forward faces 57 and 59 of mounts 54 and 56 are disposed rearwardly of front edge 52 so the curved portion of each hanger only protrudes slightly beyond the front of first support bar 14. In preferred form, mount 54 may be formed with an intermediate section cut away leaving a front and rear portion protruding above top surface 30. Forward openings 58 and 60 are disposed in mounts 54 and 56, respectively, along a transverse axis and provide a bearing for each pin journal. Each opening is sized to snugly receive each pin journal of its respective hanger so that the frictional contact between surface of the pin journal and the internal side wall of each opening must be forceably overridden to rotate the hanger.

Another mount 62, similar to mount 54, is provided at the outward end of the second support bar 16. Opening 64 is formed along a transverse axis and is sized to snugly receive hanger 22.

As can be best seen in FIG. 2, in the first configuration of bat rack 10, each forward opening hook engages the open weave fence at a point which is forward of the rear edge and above upper surface of each support bar 14. Since the support members are suspended immediately adjacent the front edges and contacts open weave fence 12 with the rear edges, the moments caused by the weight of the bat 26 tending to tilt the bat rack are partially equalized. Accordingly, this improves the planar stability of the bat rack by reducing the inherent tendency to rotate under the weight of a plurality of weighty bats. In addition, this positioning of forward opening hook 50 causes a slight front to rear cant as they are suspended from the chain-link fence. This cant can be particularly important in maintaining the proper attitude of bat rack 10 in that the well-known chain-link type fences and, particularly older chain-link fences, tend to sag either as the result of normal usage or under the weight of a plurality of bats. In the event that the chain-link fence is sufficiently loose so that the weight of the bats still causes a rear to front cant, the hanger can be easily bent at the curved connection of intermediate portion 53 and pin journal 52 to introduce compensating front to rear cant.

Figure 7:
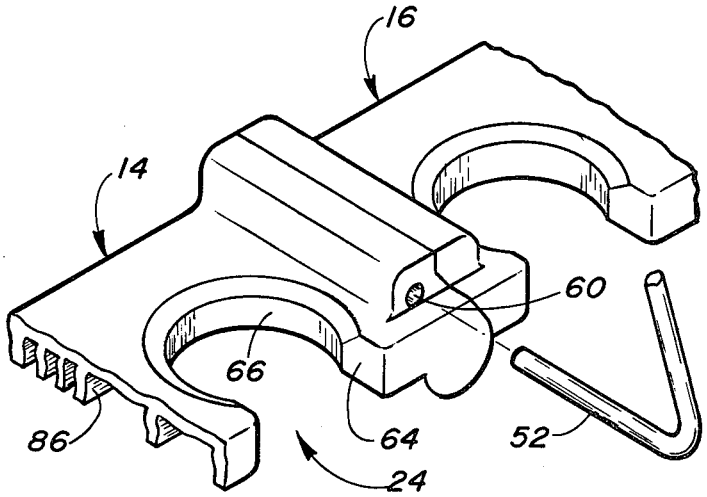
FIG. 7 is an enlarged perspective view of the support bars with a hanger, in fragment, exploded therefrom.

It has been described heretofore that bat rack 10 is horizontally suspended in the first configuration to receive and store a plurality of bats in individual forward opening recesses 24. Referring now to FIG. 7 in conjunction with FIG. 1, it will be seen that each forward opening recess 24 is "keyhole" shaped to assist in preventing inadvertent sliding of bat 26 from bat rack 10. Each recess 24 has a first more narrow portion 64 communicating with front edge 32 and a wider portion 66 disposed inwardly from narrow portion 64 and communicating therewith. As illustrated in FIG. 1, a conventional bat 26 is circular and has a varying cross sectional diameter. Knob 70 is disposed at one end of the bat adjacent to the hand grip 72. Accordingly, bat 26 must be lifted slightly in a vertical direction from its position at rest on bat rack 10 to withdraw the bat through more narrow portion 64 and remove it from forward opening recess 24. In preferred form, to further aid in preventing a bat from inadvertently sliding from bat rack 10, the wider portion 66 of each forward opening recess 24 is chamfered along upper surface 30 for improved contact with the mating portion of bat knob 25.

Figure 5:
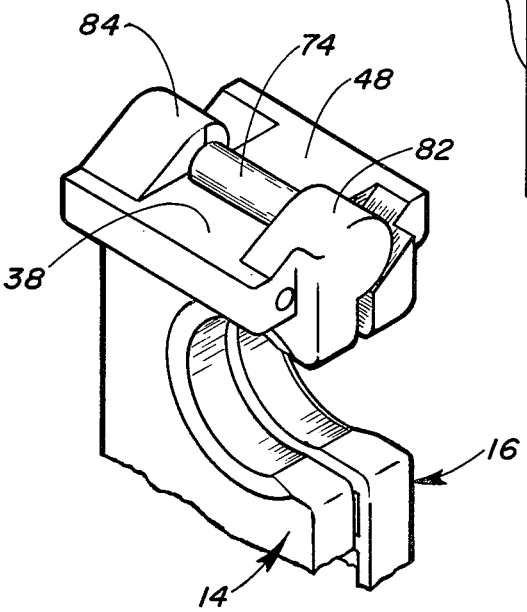
FIG. 5 is an enlarged perspective view of the support bars in the second configuration illustrating the folded position.
Figure 6:
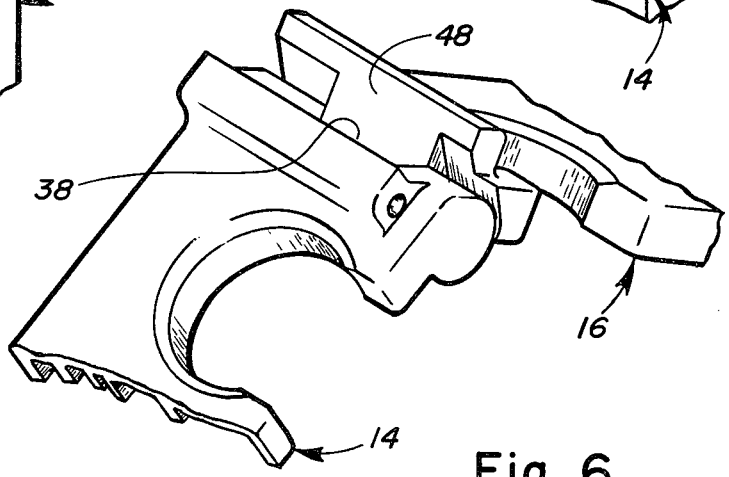
FIG. 6 is an enlarged perspective view of the support bars illustrating a position intermediate of the first and second configurations.

It has previously been described that bat rack 10 is foldable forming a shorter more compact assembly. In the second configuration bat rack 10 is approximately one-half of its extended length. Referring now to FIGS. 5 through 7, hinge 28 is disposed near the adjacent ends of first and second support bars 14 and 16. In preferred form, hinge 28 is a "knuckle hinge" type comprising transverse pin 74 attached to second support bar 16 intermediate of oppositely extending heads 76 and 78. The end of second support bar 16 includes a vertical elongated wall for increasing the surface in contact with the adjacent end of first support bars 14.

A front bearing portion 82 and a rear bearing portion 84 are formed near end of first support bar 14. Preferably, front bearing 82 comprises a blind opening (not shown) sized to rotatably receive head 76 of hinge pin 74. Rear bearing portion 84 is a cylinder having open ends and a portion of the side wall cut away to allow the portion end wall attached to transverse pin 74 to pass therethrough when separating the detachable support bars.

Figure 4:
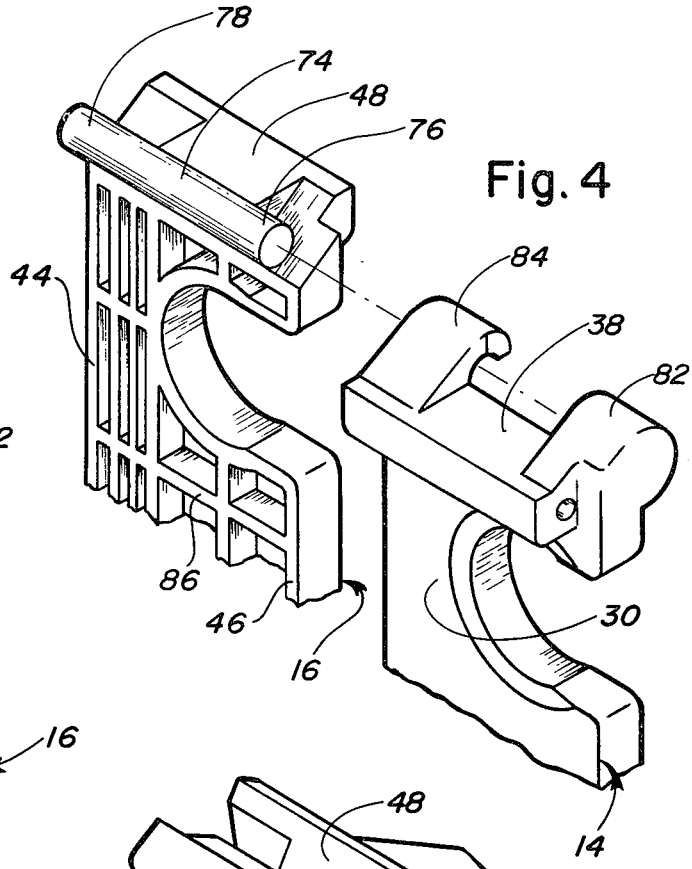
FIG. 4 is an enlarged perspective view of the adjacent ends of the support bars illustrating the separable hinge.

As has been mentioned herebefore, the support bars 14 and 16 of bat rack 10 are detachable so that the first support bar 14 can be independently used to receive and store a lesser number of bats. Many teams use only four or five bats during a game even though a greater number may be used at practice. These bats could be of the conventional type fabricated from wood or the new type manufactured from aluminum. As is known, aluminum bats are generally more expensive to initially purchase but ordinarily are more durable and long lasting in use. Referring now to FIGS. 4 and 5, second support bar 16 is detached by first positioning the support bars in the second configuration as shown in FIG. 5. The support bars are then grasped in opposite hands and moved transversely causing head 76 of hinge pin 74 to disengage from the blind opening in forward bearing 82. The end of the second platform 16 passes through the cut out portion of cylindrical bearing portion 84 separating the two platforms.

A significant advantage of the herein described portable bat rack is that it can be constructed from many of the well-known plastic materials in a conventional injection molding process and still support the weight of a plurality of conventional bats. Although there are numerous types of plastic from which the bat rack could be formed, it has been found that a standard ABS type plastic is quite satisfactory from the standpoint of both ruggedness and low cost. In addition, it has an attractive high gloss surface luster and is generally available in a wide variety of colors. Other plastic materials such as flexible polyethylene or standard rigid polyvinyl chloride could also be used in constructing the hereabove described invention. It should be understood, however, that other types of materials, such as wood or aluminum, could be used in conjunction with the instant invention.

Referring now to FIG. 4, it has been described that bat rack 10 comprises first and second support bars 14 and 16 for receiving and storing a plurality of bats. The support bars are suspended only near the ends thereof causing significant structural beam stress under the weight of a plurality of bats. If constructed from the preferred plastic material, a plurality of webs 86 are moldingly secured to the underside of the upper surface and the flange formed along the front and rear edges adding strength and rigidity to each support bar.

In preferred form, first support bar 14 and second support bar 16 are approximately 13 inches in length by $2\frac{1}{4}$ inches in depth and $\frac{1}{2}$ inches thick. The hangers are fabricated from a 13 inch length of $\frac{1}{8}$ inch diameter spring steel, preferably galvanized with nickel or zinc to resist deterioration in outdoor use, and formed as hereabove described. Final assembly of bat rack 10 only involves the connection of first support bar 14 with second support bar 16 as hereabove described and the insertion of the hanger in the openings of their respective mounts along the upper surface of the bat rack.

In the preferred embodiment, bat rack 10 is approximately 26 inches in length in the first configuration thereof. Ideally there are five forward opening recesses 24 on each support member so that a total of ten bats may be stored for ready access to the batter.

In the second configuration bat rack 10 can be folded to a compact size having external dimensions of approximately 13 inches in length by 2 inches in height and $2\frac{1}{4}$ inches in depth. This relatively small size combined with the extremely light weight of the bat rack makes it convenient to carry either in an equipment bag or even a hip pocket. It can then be easily stored in this same configuration until it is again used at the ball park.

The invention herein disclosed may be embodied in other specific forms without departing from the spirit or central characteristics thereof. The present embodiment is therefore to be considered as illustrative and not restrictive, the scope of the invention being indicated by the appended claims rather than by the foregoing description and all changes which come within the meaning and range of equivalency of the claims are therefore to be embraced therein.

What is claimed is:

1. A bat rack with a first, open, configuration attachable to an open weave fence for the storage of baseball bats and a second, closed, configuration for transporting the rack, comprising:

a first and second support bar for receiving a plurality of bats, each having front and rear edges, spaced ends, an upper surface, and forward opening recesses spaced along its length and communicating with said front edge to separately receive and hold each bat in a substantially vertical position, each recess having a width smaller than the width of the handle knob of the bat;

a first and second hanger pivotally connected to said first support bar, each hanger including a forward opening hook attachable to the open weave fence, said hangers being positionable normal to said upper surface in the first open configuration of said bat rack, and said hooks being engageable with the fence at a point forward of said rear edge and above said upper surface, and said hangers also being rotatable to a position parallel to and contacting said upper surface of said first support bar in the second closed configuration of said bat rack;

a hinge disposed between said first and second support bars and attached near adjacent joined ends of said first and second support bars, said adjacent joined ends abutting in the first configuration thereof;

a third hanger pivotally connected to said second support bar near the free end thereof, said third hanger also including a forward opening hook attachable to the open weave fence forward of said rear edge of said second support bar;

whereby in the first open configuration thereof the moments tending to tilt the bat rack are partially equalized by said hangers engaging said open weave fence forward of said rear edge of each support bar and whereby said bat rack is foldable to a size of lesser overall dimensions in the second configuration thereof.

2. A bar rack according to claim 1, wherein said hinge is separable so that said first support bar can be used independently to support a plurality of bats in a vertical position.

3. A bat rack according to claim 1, wherein said hinge comprises an axially elongated pin connected to one of said adjacent joined ends of said support bars, and bearing means attached to the other of said adjacent joined ends, and wherein each adjacent joined end includes a vertically elongated wall which is in substantial alignment with the hinge axis, and wherein said elongated walls abut in the first configuration thereof.

4. A bat rack according to claim 1, wherein said hinge comprises an elongated pin that has a pair of oppositely extending heads and that is attached intermediate of said heads adjacent to and parallel to one of said adjacent joined ends, and wherein said hinge also includes bearing means attached to the other of said adjacent joined ends, said oppositely extending heads being rotatably received in said bearing means.

5. A bat rack according to claim 1, wherein said hinge is operable to rotate about an axis parallel to said adjacent joined ends, and wherein said hinge comprises bearing means secured to one of said adjacent joined ends, and a pin a portion of which is secured to the other of said adjacent joined ends, and wherein said bearing means comprises a front section and a rear section, each section rotatably cooperating with said pin.

6. A bat rack according to claim 5, wherein said front and rear sections are attached near the front and rear edges, respectively, of said one of said adjacent joined ends, and wherein one of said sections comprises a cylinder having a portion of its side wall cut away so that the portion of the pin secured to said other of said adjacent joined ends can be axially moved through the cut away portion of the side wall of the cylinder thereby detaching the first and second support bars.

7. A bat rack according to claim 1, wherein each said forward opening recess comprises a more narrow portion communicating with said front edge of its respective support bar, for receiving a bat near the bat's portion of least diameter, and a wider portion for engaging the bat's handle knob thereby preventing the bat from being inadvertently displaced from the bat rack.

8. A bar rack according to claim 1, wherein each forward opening recess is chamfered along the portion thereof in substantial contact with its respective bat thereby cooperating with the mating portion of the bat's handle knob to prevent the bat from inadvertently sliding from its support bar.

9. A weight equalized bat rack attachable to an apertured surface for the storage of baseball bats, comprising:

a support bar having an upper surface, front and rear edges, which are spaced apart and a plurality of forward opening bat receiving recesses aligned longitudinally; wherein each recess communicates with said front edge to independently receive and maintain a bat in a substantially vertical position through engagement with the handle knob of the bat;

a pair or wire hangers pivotally attached to said support bar, each hanger having a hook at its upper end that is laterally adjusted when said hanger is pivoted, a straight front mounted hanger pin journal at its lower end, and an intermediate portion extending between said hook and said hanger pin journal, and each hanger being longitudinally rotatable between a substantially upright position with respect to said upper surface and suspending the bat rack and a position substantially parallel to said upper surface for compact storage and transportation of the bat rack;

a transverse hanger bearing disposed near each end of said bat rack for rotatably receiving a hanger pin journal, each hanger bearing having an opening near said front edge from which its respective hanger pin journal protrudes for front suspension of said bat rack at a single point adjacent each end of said bat rack;

whereby said hooks, when substantially upright, engage said apertured surface at points rearward of said front edge and above said upper surface so that said support bar is front suspended at both said ends.

10. A bat rack according to claim 9, further comprising a second support bar having an adjacent joined end secured to an adjacent joined end of said first support bar, and including an upper surface, front and rear edges, a plurality of forward opening bat receiving recesses aligned longitudinally and communicating with said front edge, and a hanger having a hook at its upper end, a hanger pin journal at its lower end, and an intermediate portion therebetween wherein said hanger pin journal is pivotally attached adjacent the free end of said second support bar, said hanger being longitudinally movable between an upright position with respect to said upper surface of said second support bar and a position substantially parallel to said upper surface of said second support bar.

11. A bat rack according to claim 10, wherein said adjacent joined ends are secured together by a hinge comprising an axially elongated hinge pin secured adjacent to and parallel to one of said adjacent joined ends, and hinge bearing means secured adjacent to and parallel to the other of said adjacent joined ends, whereby said first and second support bars are coplanarly positionable allowing abutting of said adjacent joined ends when said bat rack is positioned to receive bats, and are foldable in one direction to a substantially parallel shortened configuration.

12. A bat rack according to claim 10, wherein said adjacent joined ends are interconnected by a hinge comprising a double headed pin having a central portion which is secured adjacent to and parallel to one of said adjacent joined ends, and hinge bearing means having front and rear sections attached parallel to and adjacent to the other of said adjacent joined ends, said front and rear sections being sufficiently spaced apart so that said central portion can rotate therebetween.

13. A bat rack according to claim 12, wherein said front section comprises a rearwardly opening socket sized to receive one of said heads and is mounted near the front edge of its respective support bar, and wherein said rear section comprises a cylinder with both ends open coaxially aligned with said front section and mounted on the rear edge of said respective support bar and has a part of its side wall cut away so that said heads can be axially engaged and disengaged with said front and rear sections when the first and second support bars are in a substantially parallel configuration.

14. A bat rack according to claim 9, wherein each said laterally adjustable hook opens forwardly to engage said apertured surface from the rear.

* * * * *

UNITED STATES PATENT OFFICE

CERTIFICATE OF CORRECTION

Patent No. 4,049,126 Dated September 20, 1977

Inventor(s) Lance K. Halverson

It is certified that error appears in the above-identified patent and that said Letters Patent are hereby corrected as shown below:

Column 7, Claim 2, Line 41, change "bar" to --bat--

Column 8, Claim 8, Line 17, change "bar" to --bat--

Column 8, Claim 9, Line 27, after "edges," insert --ends--

Column 8, Claim 9, Line 34, change "or" to --of--

Column 8, Claim 9, Line 42, change "and" to --for--

Signed and Sealed this

Tenth Day of January 1978

[SEAL]

*Attest:*

RUTH C. MASON
*Attesting Officer*

LUTRELLE F. PARKER
*Acting Commissioner of Patents and Trademarks*